US007353947B2

(12) United States Patent
Weissbrod

(10) Patent No.: US 7,353,947 B2
(45) Date of Patent: Apr. 8, 2008

(54) WELDING WIRE DRUM AND UNITIZED PACKAGE FOR SAME

(75) Inventor: Paul A. Weissbrod, So. Euclid, OH (US)

(73) Assignee: Lincoln Global, Inc., City of Industry, CA (US)

( * ) Notice: Subject to any disclaimer, the term of this patent is extended or adjusted under 35 U.S.C. 154(b) by 165 days.

(21) Appl. No.: 10/179,379

(22) Filed: Jun. 26, 2002

(65) Prior Publication Data

US 2004/0000498 A1 Jan. 1, 2004

(51) Int. Cl.
*B65D 85/20* (2006.01)
*B65D 85/00* (2006.01)
*B65D 19/00* (2006.01)

(52) U.S. Cl. ..... 206/446; 206/386; 206/389; 206/598; 206/814

(58) Field of Classification Search ..... D6/415, D6/455, 465; 53/399; 108/57.33, 57.13; 206/389, 395, 396, 397, 408, 409, 386, 596–600, 206/159, 161, 814, 446, 504, 821; 220/23.4, 220/636, 669, 674, 4.04; 211/85.18–85.23; D34/39; 242/600, 614

See application file for complete search history.

(56) References Cited

U.S. PATENT DOCUMENTS 2,404,513 A * 7/1946 McCabe ..... 211/85.18
3,065,857 A * 11/1962 Sanders ..... 211/85.19
3,454,156 A * 7/1969 Chatten ..... 206/160
D214,922 S * 8/1969 Schier et al. ..... D6/415
3,942,670 A 3/1976 Mingus
4,033,454 A 7/1977 Santoni
5,048,708 A * 9/1991 Musco ..... 220/23.4
5,224,746 A * 7/1993 Mullins ..... 294/87.1
5,259,524 A * 11/1993 Eckert ..... 220/23.4
5,385,233 A * 1/1995 McKibben et al. ..... 206/386
5,819,934 A 10/1998 Cooper
6,237,768 B1 5/2001 Cipriani

FOREIGN PATENT DOCUMENTS

JP 6-293373 10/1994
JP 6293373 10/1994
JP 2000-335639 12/2000

* cited by examiner

*Primary Examiner*—J. Gregory Pickett
(74) *Attorney, Agent, or Firm*—Fay Sharpe LLP; Brian E. Turung

(57) ABSTRACT

A unitized package of a plurality of drums filled with coiled welding wire, each drum comprising a cylindrical body, a top rim, a bottom rim and a bottom circular wall fixed to the bottom rim and having a peripheral shape. The package comprises: a spacer between the cylindrical bodies, a first band stretched around the plurality of drums adjacent the top rim, and a second band stretched around the plurality of drums adjacent the bottom rim wherein each drum has a riser network permanently fixed to the bottom wall and formed from thin elongated elements with a given height greater than about two inches. A lower support plate is permanently attached to the riser network and is parallel to the bottom wall of the drum to provide an integral pallet on each drum.

17 Claims, 12 Drawing Sheets x
L
12
20
D
10
W
22
16
14
50
52
62
P
2
70
70
64
68
70
2
60
66
70

WELDING WIRE DRUM AND UNITIZED PACKAGE FOR SAME

The present invention relates to the art of drums for transporting and paying out arc welding wire and more particularly to an improved drum structure together with a unitized package for such drums.

BACKGROUND OF INVENTION

High production electric arc welding often involves a robot for performing a series of repetitive welding operations. Such robot uses electric arc welding wire from a coiled supply, normally provided in cylindrical drums of the type generally shown in Cooper U.S. Pat. No. 5,819,934, incorporated by reference herein. Such drums are used to coil the welding wire as it is drawn so that a large volume of wire is provided from a single cylindrical drum from which it is payed out to the automatic welder operated by the robot. When the coiled wire is coiled in the drum, the drum is closed and transported to the manufacturing facility where the lid is removed and a member referred to as a "hat" is placed over the drum to feed the wire from the drum to the wire feeder of the welding operation. As shown in Cooper U.S. Pat. No. 5,819,934, the drum has a bottom support wall, which is flat. After the drum has been filled, it is transported to the manufacturing facility. To facilitate handling of the drum, the drum is often banded to a pallet used to lift the drum during transportation and manipulation at the manufacturing facility. Then, the banded pallet must be removed before use of the drum for paying out electric welding wire. For economy, several drums, normally four, are placed upon a master pallet which has three downwardly extending ribs, such as 2×4 sections, to create a space under the master pallet for the prongs of a fork lift. Consequently, four drums are placed upon the master pallet and are banded together in a generally square pattern or configuration. The master pallet supporting the four drums is then lifted by a fork lift and moved to the transporting vehicle. Shipping of four drums in a unitized package using a lower master pallet does reduce the cost of transporting and handling. However, disadvantages are experienced. At the facility receiving the unitized package of drums steps must be taken to dispose of the master pallet. The master pallet is sometimes damaged during transport and use. To remove the drums from the master pallet and place them in a standard drum dolly, the drums must be lifted from the top. This is difficult and strains the bottom wall. As one drum is used up, a second drum is removed from the master pallet and conditioned for wire payout by removing the lid and applying the hat. After all four drums of the package are used, the master pallet is discarded. Thus, even though unitized packaging of several wire drums reduced the cost of transportation, there are still substantial difficulties in handling the master pallet and manipulating the various drums at the manufacturing facility.

THE PRESENT INVENTION

The present invention eliminates the need for a master pallet, while still maintaining the ability to employ a unitized package involving a plurality of welding wire drums, such as four drums arranged in a square pattern. By using the present invention, the unitized package can be maintained as a unit on the welding floor. When one drum is exhausted, the lid of the second drum is removed and the drum is fitted with a wire feeding hat, while the first drum remains in the package. This procedure could not be done in the past, since the chimes at the top rim of the drums banded together in a tight unitized package could not be individually withdraw to remove the lid. By using the present invention, each drum is spaced from the other drums so that there is no interference between the adjacent chimes and an individual lid can be removed, the drum fitted with a hat and then placed in service, without the need to remove the prior drum.

The invention involves a unitized package for a plurality of drums filled with coiled welding wire. Each of the drums comprises a cylindrical body, a top rim, a bottom rim and a bottom circular wall fixed to the bottom rim and having a peripheral shape. Thus, all of the drums of the unitized package are the same as drums previously manufactured and used. However, in accordance with the present invention, a spacer is provided between the cylindrical bodies before the plurality of drums are banded together by a first band stretched around the drums at the top rim and a second band stretched around the plurality of drums at the bottom rim. Consequently, the present invention involves a unitized package of a plurality of drums filled with welding wire. The unitized package involves a spacer between the individual cylindrical bodies so that when the bodies are banded together there is a space between the upper rims where the chimes and lids are mounted. Thus, the lid from one drum is removed without disturbing the continuity of the unitized package. By using a spacer between the individual drums, the unitized package can be located at the welding operation. As a first drum is exhausted the next drum is used without the need to separate and individually handle the drums. The unitized package for a plurality of welding wire drums is novel and has the advantage of being able to use each of the drums in succession without disassembling the package as required in the past.

In accordance with another aspect of the present invention, there is provided an improvement for the individual wire drum. The drum includes a cylindrical body with a center axis, a top rim, a bottom rim and a bottom circular wall fixed to the bottom rim and having a peripheral shape. This is a standard description of a welding wire drum of the type show in Cooper U.S. Pat. No. 5,819,934. This drum is improved by providing a riser network formed from thin elongated elements with a given height greater than about two inches. Indeed, the riser network is preferably two generally parallel strips formed by a length of a 2×4 board. These risers are permanently fixed to the bottom wall of the drum. In this manner, the drums are picked up individually from the bottom and not necessarily from the top. They can be placed in a standard drum dolly. To eliminate the need for a master pallet, each of the riser networks on the individual drums is provided by a lower generally square plywood plate permanently fixed to the riser elements. Thus, each drum includes a riser network in the form of two parallel elements with a lower square plate. The square plate is generally circumscribed by the peripheral shape of the drum. The plates does not extend beyond the profile of the drum. In practice, each corner of the square plate is generally coextensive with the peripheral shape of the drum. In other words, a body view of the riser network has a square with the corners in line with the cylindrical wall of the drum. Parallel riser elements are normally parallel with one set of edges of the bottom support plate and are perpendicular to the other set of edges. The riser elements are on opposite sides of the drum center line so that the structure on the bottom of each drum forms an integral pallet. By having an integral pallet on the bottom of each drum, there is no need for a master pallet. By orienting the drums with the riser elements parallel and aligned with each other, a fork truck can lift the four drums assembled into a unitized package by a band around the top and bottom of the drum. A spacer in the middle separates the individual drums from each other and is held in the center of the package by the surrounding bands.

By using the present invention, there is no need for a master pallet that must be transported with the unitized package of drums. The drums are provided with an integral riser network that facilitates handling. The bottom support plate of the riser matches the standard pallet jack to lift the drum and place the drum vertically downwardly into a standard drum dolly. Thus, the drum having the integral lower pallet can be placed in the drum dolly for transportation individually either at the manufacturing facility or the user facility. This is an advantage over lifting a drum from the top to place it in a standard drum dolly. There is no need to grab the drum from the top rim during transportation or manipulation of the drum either at the manufacturing facility or the ultimate user facility. By providing a spacer between the drum bodies, the chimes of the individual drums are not in contact and are not damaged during shipping. Indeed, this allows removal of the lid for use of a drum, without disassembling the drum from the package at the user facility. Thus, the chime and/or lid can be withdrawn and a hat can be assembled without need to remove the individual drums from the unitized package employed during shipping.

There is another advantage of the integral pallet. By providing a square support plate as an element of the integral pallet permanently affixed on the bottom of the drum, the drum can not be tilted and rolled at the welding facility. Tilting of the drum can cause the wire in the drum to shift to distort the configuration of the wire that has been specially coiled for the purposes of easy feeding. There is a further advantage of the integral pallet involving two riser elements and a generally square bottom support plate. By using this integral pallet as part of the drum, a master pallet is not necessary. Thus, the invention eliminates the disadvantages associated with the use of a master pallet in the prior art.

The primary object of the present invention is the provision of an improved drum that has an integral lower pallet to allow shipment of the drum without a master pallet.

Still a further object of the present invention is the provision of an improved drum, as defined above, which improved drum is easy to manufacture and facilitates handling of the drum both at the manufacturing facility and at the welding facility.

Another object of the present invention is the provision of a unitized package for a plurality of drums, preferably four drums in a square pattern, which unitized package allows shipment and subsequent use without need to disassemble the individual drums from the package prior to use.

Yet a further object of the present invention is the provision of a unitized package for a plurality of wire drums, as defined above, which package not only eliminates the need for a master pallet, but also allows easy feeding from individual drums without the need to disassemble the unitized package.

Another object of the present invention is the provision of a unitized package of drums, as defined above, which unitized package provides spacing between the drums to prevent damage to the chime in shipment and allows removal of the lid for use of the drum.

These and other objects and advantages will become apparent from the following description taken together with the accompanying drawings.

PREFERRED EMBODIMENT

Figure 1:
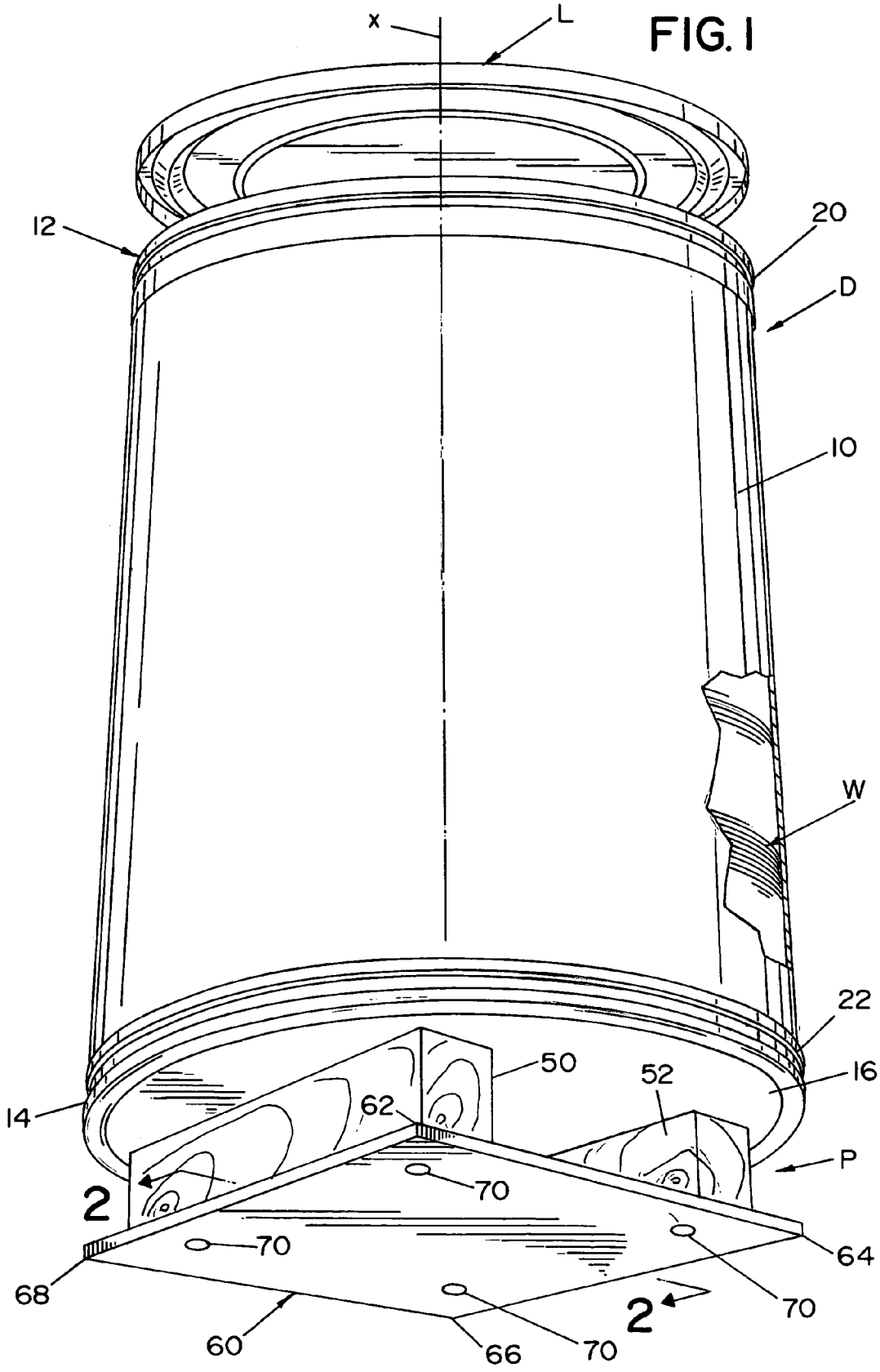
FIG. 1 is a pictorial view of the preferred embodiment of the present invention with the lid of the drum being removed.
Figure 2:
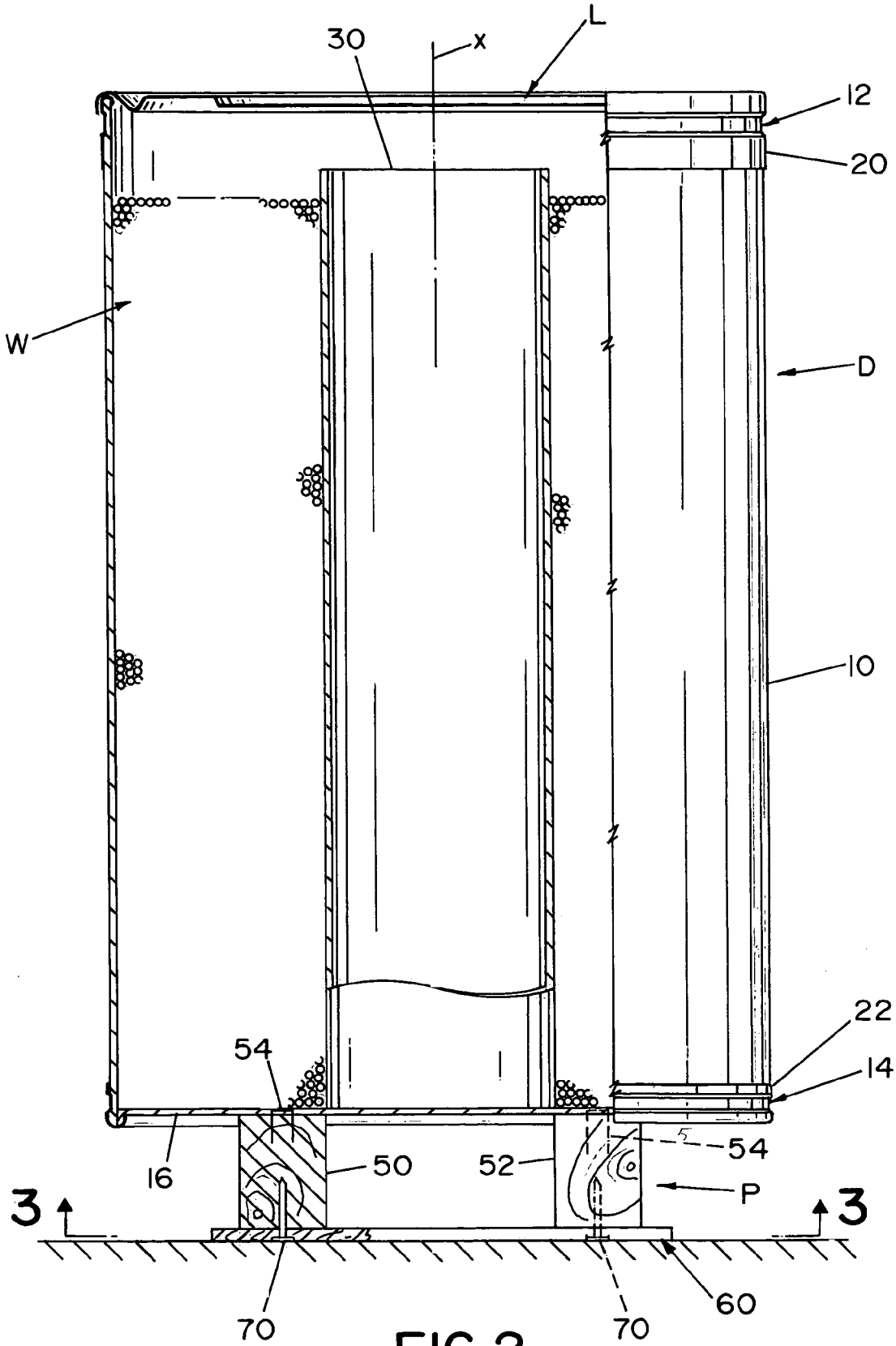
FIG. 2 is a cross-sectional view taken generally along line 2-2 of FIG. 1.
Figure 3:
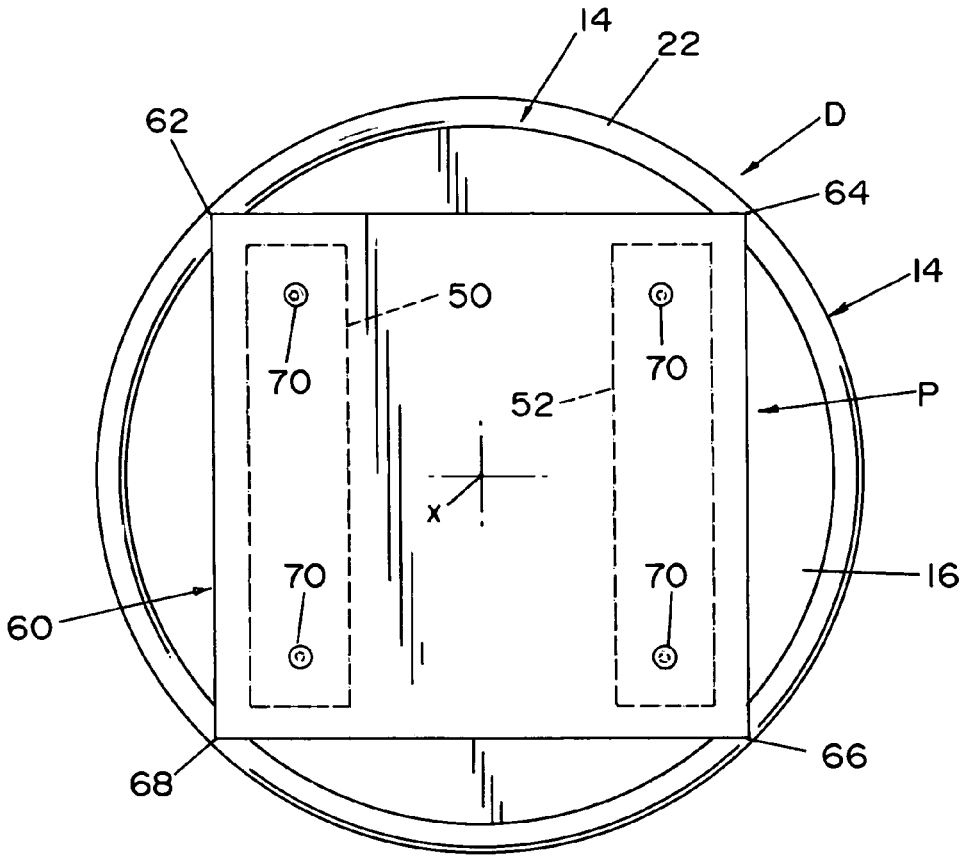
FIG. 3 is a bottom plan view showing the square support plate and riser elements with the corners of the plate generally in the periphery of the cylindrical body of the wire drum.
Figure 7:
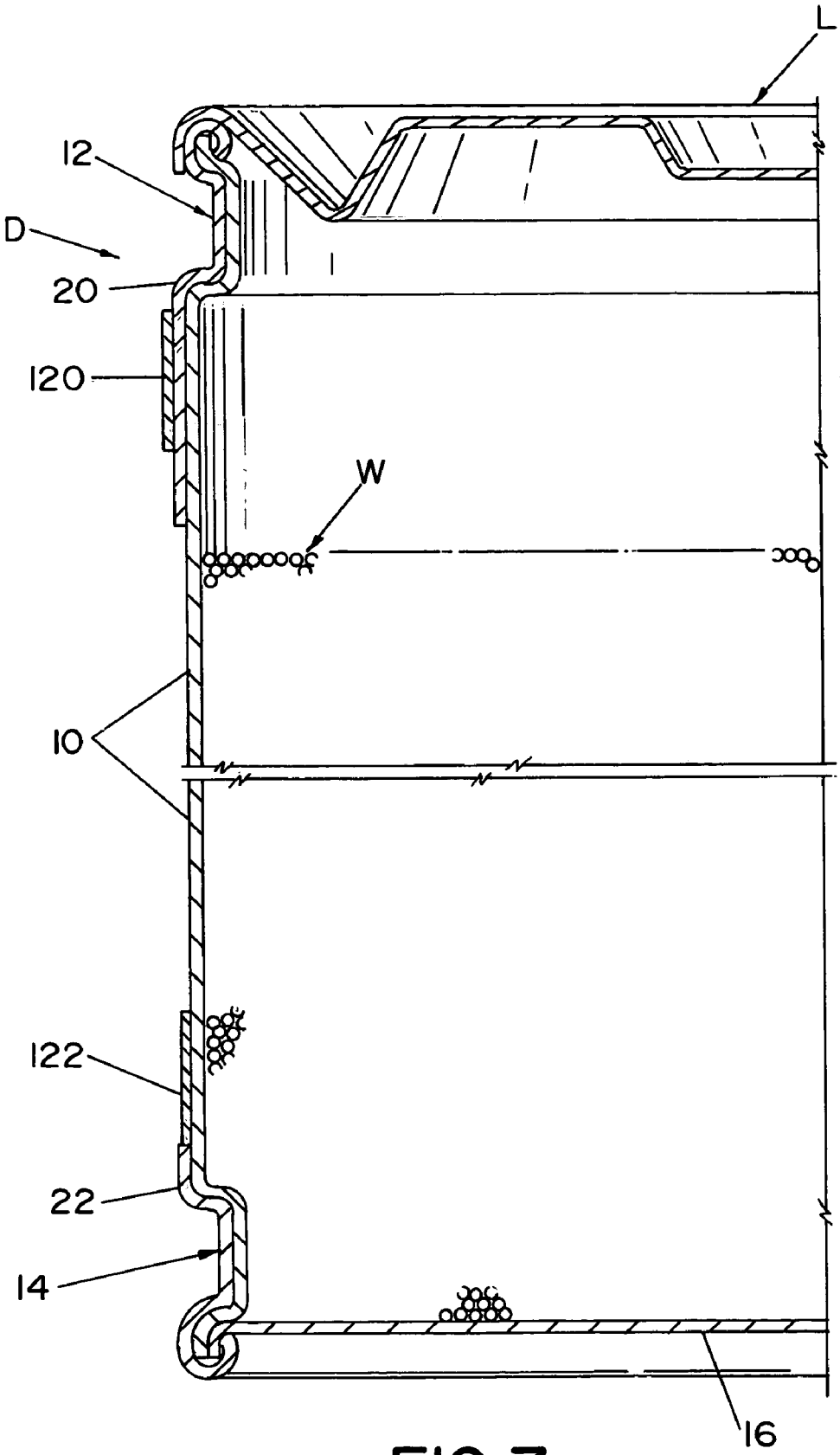
FIG. 7 is an enlarged cross sectional view taken generally along line 7-7 of FIG. 5.

Referring now to the drawings wherein the showings are for the purpose of illustrating preferred embodiments only and not for the purpose of limiting same, FIGS. 1-3 show a drum D having a cylindrical body 10, a top rim 12, a bottom rim 14 and a bottom wall 16. Chimes 20, 22 at rims 12, 14, respectively, hold the bottom wall 16 and support an upper lid L. These chimes are best shown in FIG. 7 which is a disclosure of the cross-section of a standard drum D. In accordance with standard technology, drum D includes a center hollow core 30 around which electric arc welding wire W is coiled for shipment and transportation, as disclosed in Cooper U.S. Pat. No. 5,819,934. In accordance with the invention, drum D is modified by having lower integral pallet P comprising a riser network in the form of two parallel strips 50, 52 fixed to wall 16 on opposite sides of center axis x by glue and staples 54. The riser network could take a variety of forms; however, it is preferred to use two side-by-side 2×4 boards cut to lengths, best shown in FIG. 3. The elements have a lower plywood support plate 60 preferably rectangular and in the form of a square with corners 62, 64, 66 and 68, which corners are generally coextensive with the peripheral shape of rim 14 as shown in FIG. 3. Thus, the periphery of drum D circumscribes square support plate 60 so that the corners are generally coextensive with the peripheral shape. The plate could be smaller. The large plate gives maximum stability to the integral pallet P affixed to the bottom wall 16 of drum D. Plate 60 is firmly attached to strips 50, 52 by a plurality of nails 70, only two of which are illustrated in each strip; however, additional nails and the glue can be used to rigidify the support plate as the bottom portion of integral pallet P. Lid L is removed from chime 20 to expose coiled wire W for use in a welding operation. By using the integral pallet, a cluster of four drums unitized as a package need not have a lower master pallet. The square plate on the bottom of integral pallet P prevents the drums from being tilted and rolled causing internal shifting of wire W prior to use at the welding operation.

Figure 4:
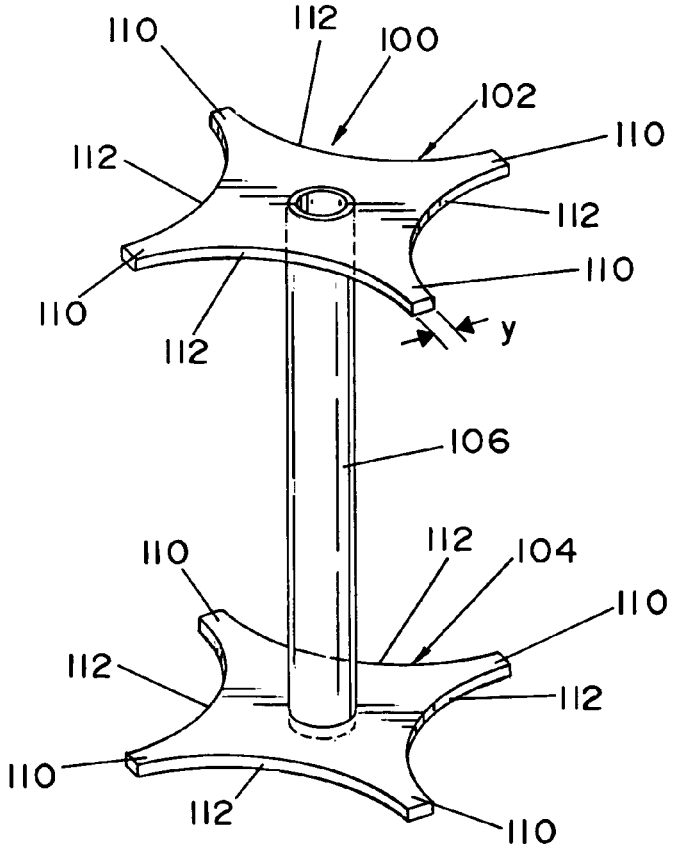
FIG. 4 is a pictorial view of a spacer used in the unitized package of the present invention.
Figure 5:
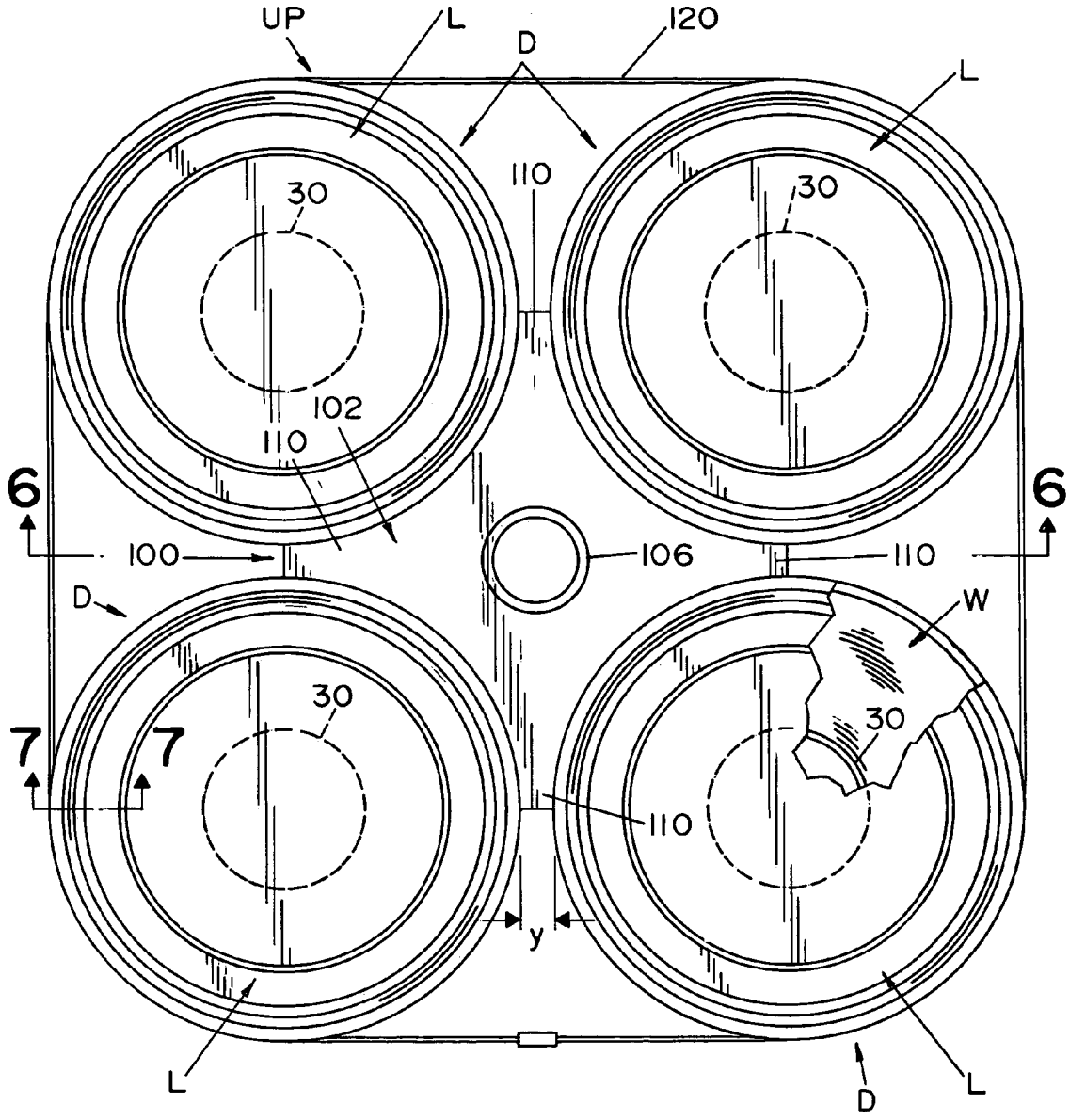
FIG. 5 is a top plan view of a unitized package constructed in accordance with the present invention and using the spacer shown in FIG. 4.
Figure 6:
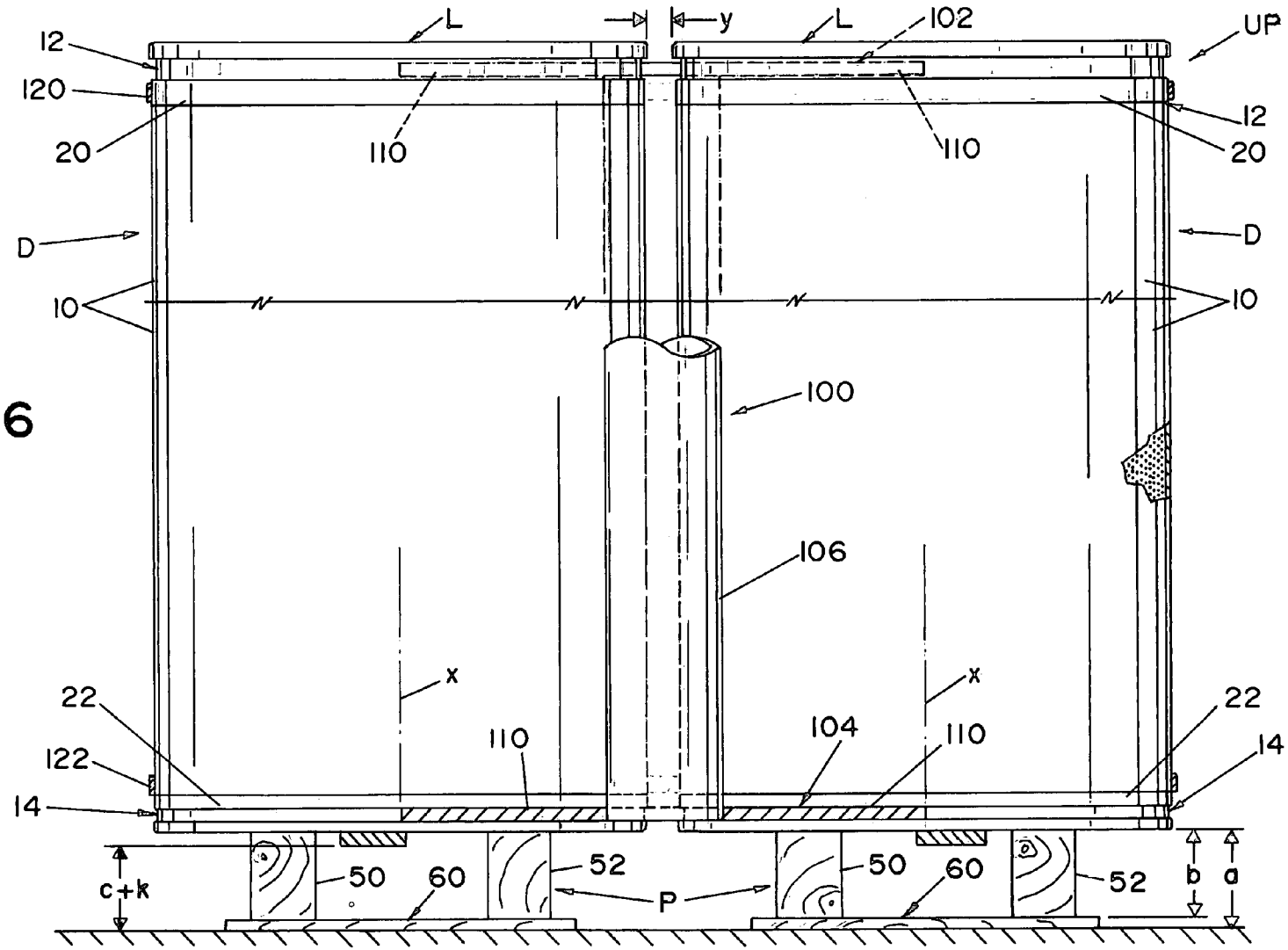
FIG. 6 is a cross sectional view taken generally along line 6-6 of FIG. 5.
Figure 8:
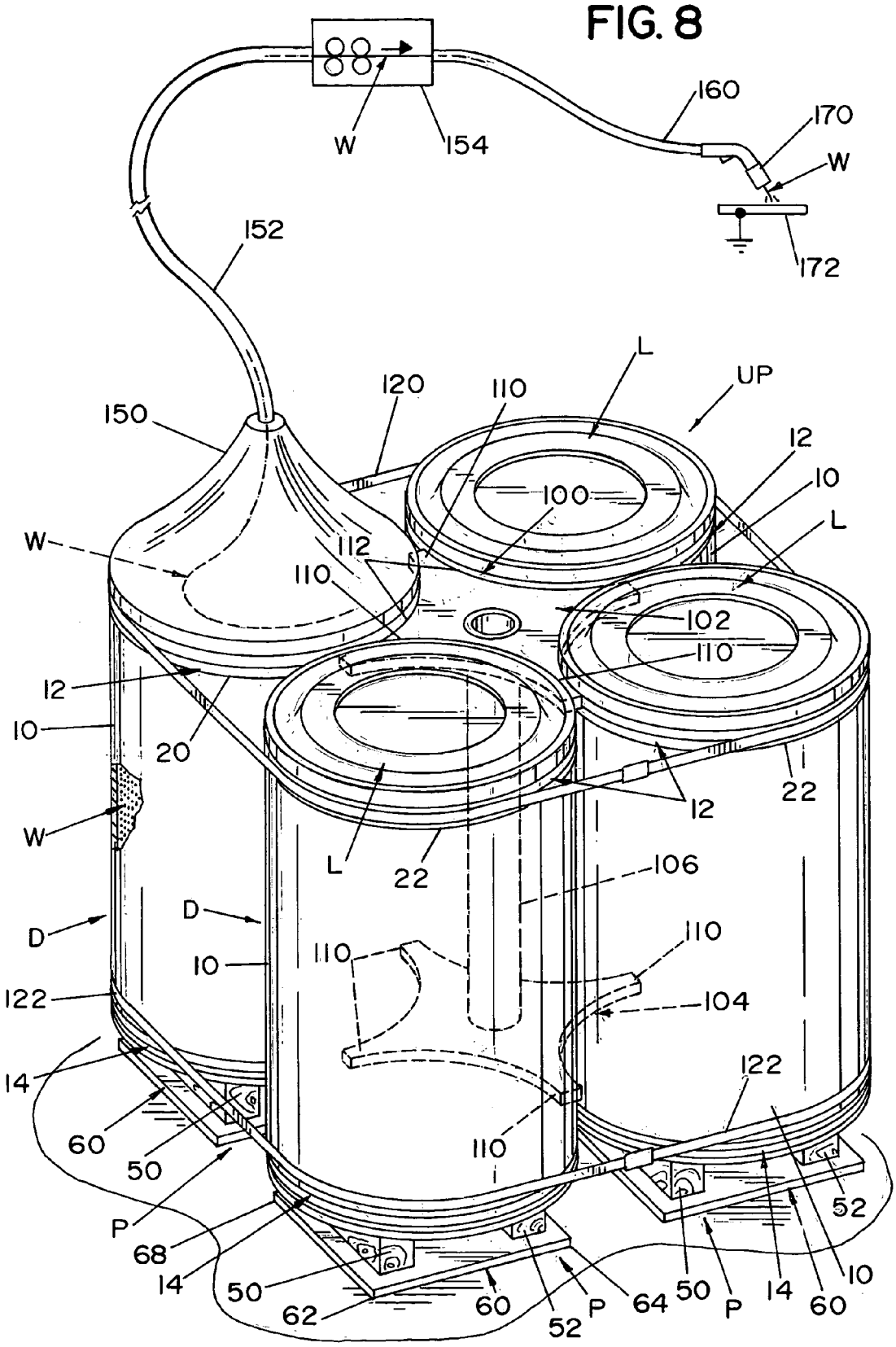
FIG. 8 is a pictorial view of the unitized package using the spacer shown in FIG. 4 and orientation of the integral pallets for the individual drums constructed in accordance with another aspect of the present invention.

In accordance with another aspect of the present invention drums D with lower integral pallet P are shipped as a unitized package UP involving binding together several drums D. In the embodiment illustrated in FIGS. 4-8, unitized package UP includes four drums D arranged in a generally square pattern. Spacer 100, best shown in FIG. 4, is constructed for use with four drums and includes an upper starwheel 102, lower starwheel 104 separated by a stanchion 106. Each wheel 102, 104 includes radially extending arms 110 having an effective width y and separated by an arcuate portion 112 generally matching the outside radius of the various cylindrical bodies 10 of the individual drums D. The surfaces locate drums D in package UP. The drums are arranged as shown in FIGS. 5 and 8 with the parallel 2×4 strips 50, 52 being aligned as shown in FIGS. 6 and 8. After arranging the drums in the square configuration with the spacer 100 in the middle for locating the individual drums with respect to each other with a spacing y, the drums are connected together by bands 120, 122 at opposite rims 12, 14 of the individual drum. As assembled, fork lift truck prongs can be inserted under each of the spaced drums shown in FIG. 6 and FIG. 8 between the lower plates 60, with the prongs extending below two of the drums in unitized package UP. In practice a shrink wrap is wound around package UP to further support drums D during shipment.

Spacer 100 separates the drums from each other so lid L can be removed from the drum and replaced by a feeding hat 150, as shown in FIG. 8. This hat is attached to a wire feed tube 152 directing wire W to wire feeder 154 and into torch hose 160. In this manner, wire W from the drum having a hat is directed to torch 170 for welding, as schematically represented by workpiece 172. By using spacer 100, unitized package UP need not be disassembled on the factory floor. After wire W in the drum with hat 150 is exhausted, lid L from another drum is removed for attachment of the hat. This procedure is continued until the wire from all four drums is exhausted. In this manner, the individual drum D need not be separated and manipulated at the welding operation. The use of spacer 100 allows the lid to be removed and prevents damage to the chimes by engagement of the chimes of adjacent drums. In the past, four drums were banded together and placed on a master pallet. The bands pressed the chimes of the adjacent drums together and required unbanding of the assembled package prior to use at the welding operation. By using the present invention, spacer 100 eliminates these difficulties and protects the individual chimes and allows removal of the lid and attachment of the hat without disassembling of the unitized package. This has substantial advantages in the factory using the welding wire. As will be described later, various other spacers and configurations can be used in practicing the present invention.

Figure 9:
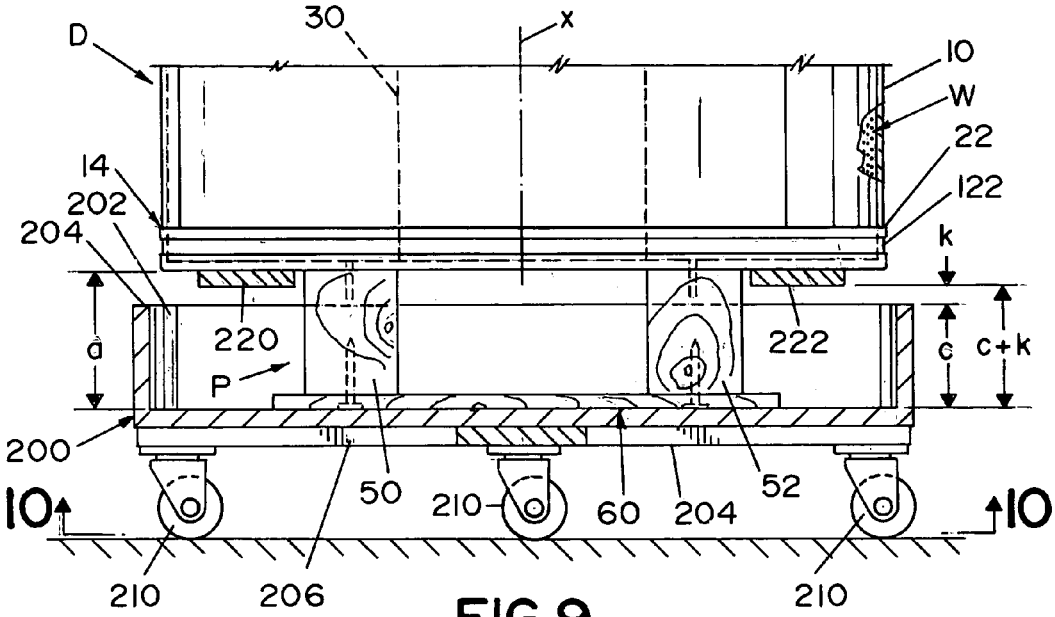
FIG. 9 is a cross sectional view of a standard drum dolly with a drum loaded for movement by the dolly by a fork lift truck using the integral pallet concept of the present invention.
Figure 10:
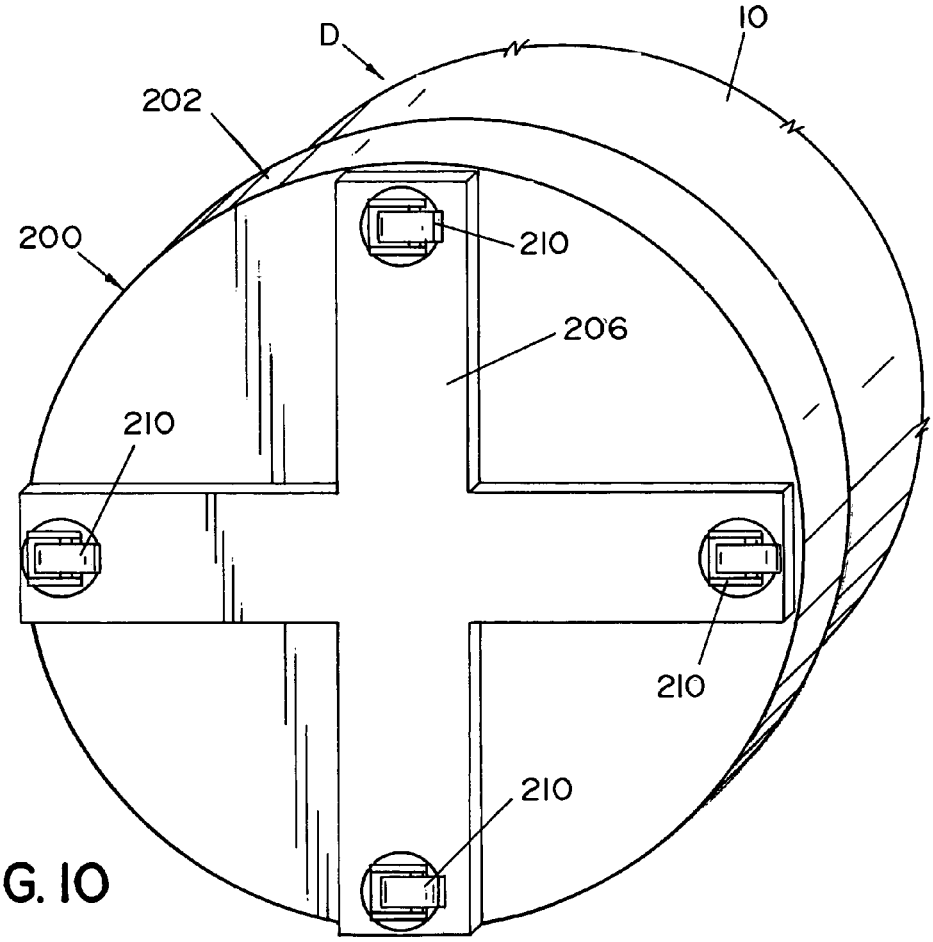
FIG. 10 is a lower partial pictorial view, taken generally along line 10-10 of FIG. 9.

Dimensional aspects and practical advantages of using integral pallet P is schematically illustrated in FIGS. 9 and 10. As shown in FIG. 6, the spacing from the bottom of the support 60 to the top of elements 50, 52 is a distance a. A standard drum dolly 200 has a cylindrical receptacle 202 with height c. Distance a is greater than height c so that there is a distance k between the bottom of fork lift prong 220, 222 and the top wall 204 of receptacle 202. Consequently, drums D can be lifted by prongs 220, 222 located on opposite sides of strips 50, 52 for depositing drum D into receptacle 202 of standard drum dolly 200. In the past, the drum had to be lifted from the top to be placed in dolly 200 for transportation at the manufacturing plant. For completeness, the bottom of dolly 200 is illustrated in FIG. 10 as including a support base 206 with downwardly extending casters 210. As shown in FIGS. 9 and 10, drum D can be lifted by a fork truck and deposited in dolly 200, thus overcoming the disadvantages in lifting the drum from the top. In addition, bottom lifting of the drum is preferred to support the weight of wire W coiled into drum D.

Figure 11:
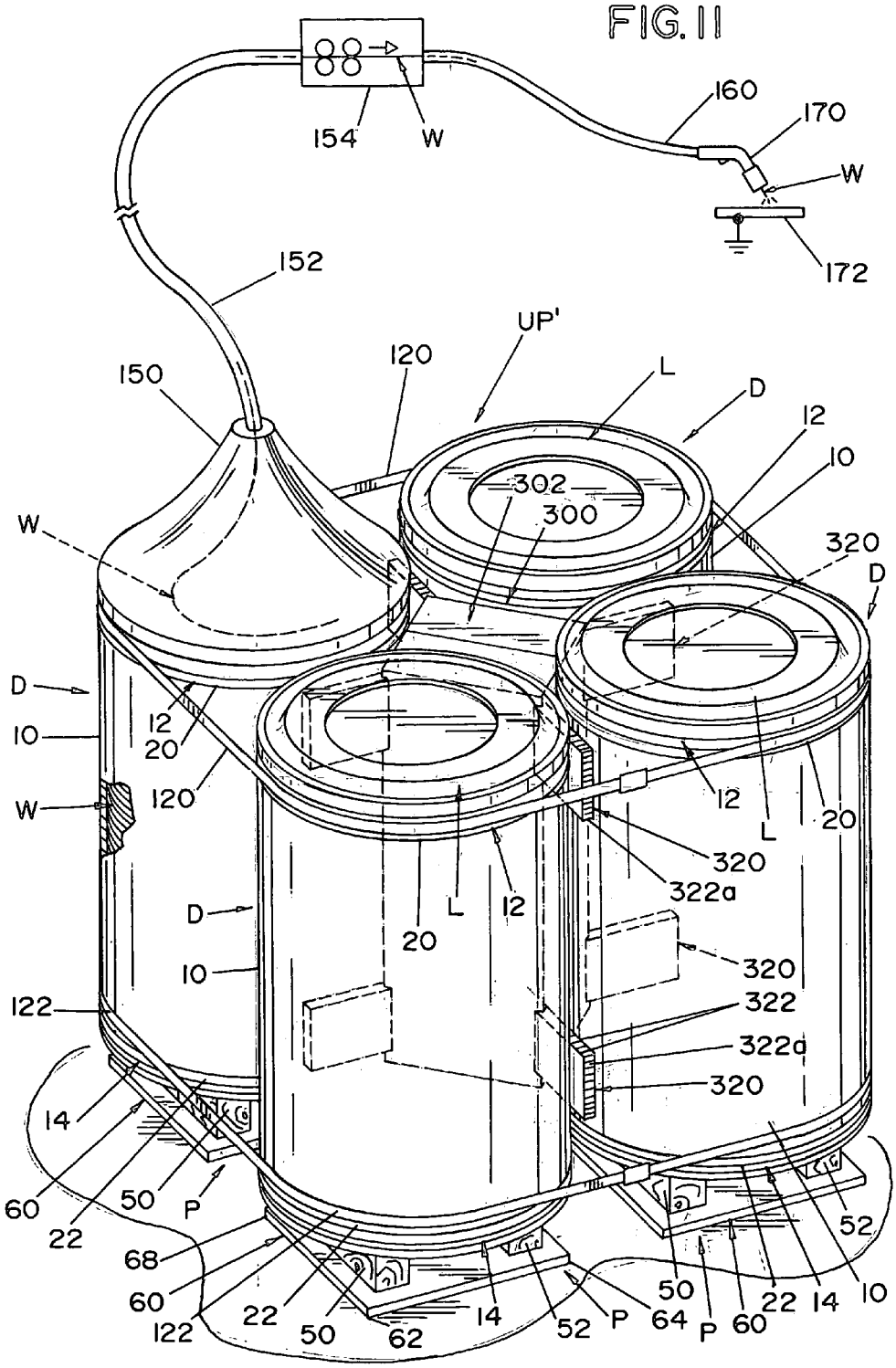
FIG. 11 is a view similar to FIG. 8 showing the preferred embodiment of the present invention.
Figure 12:
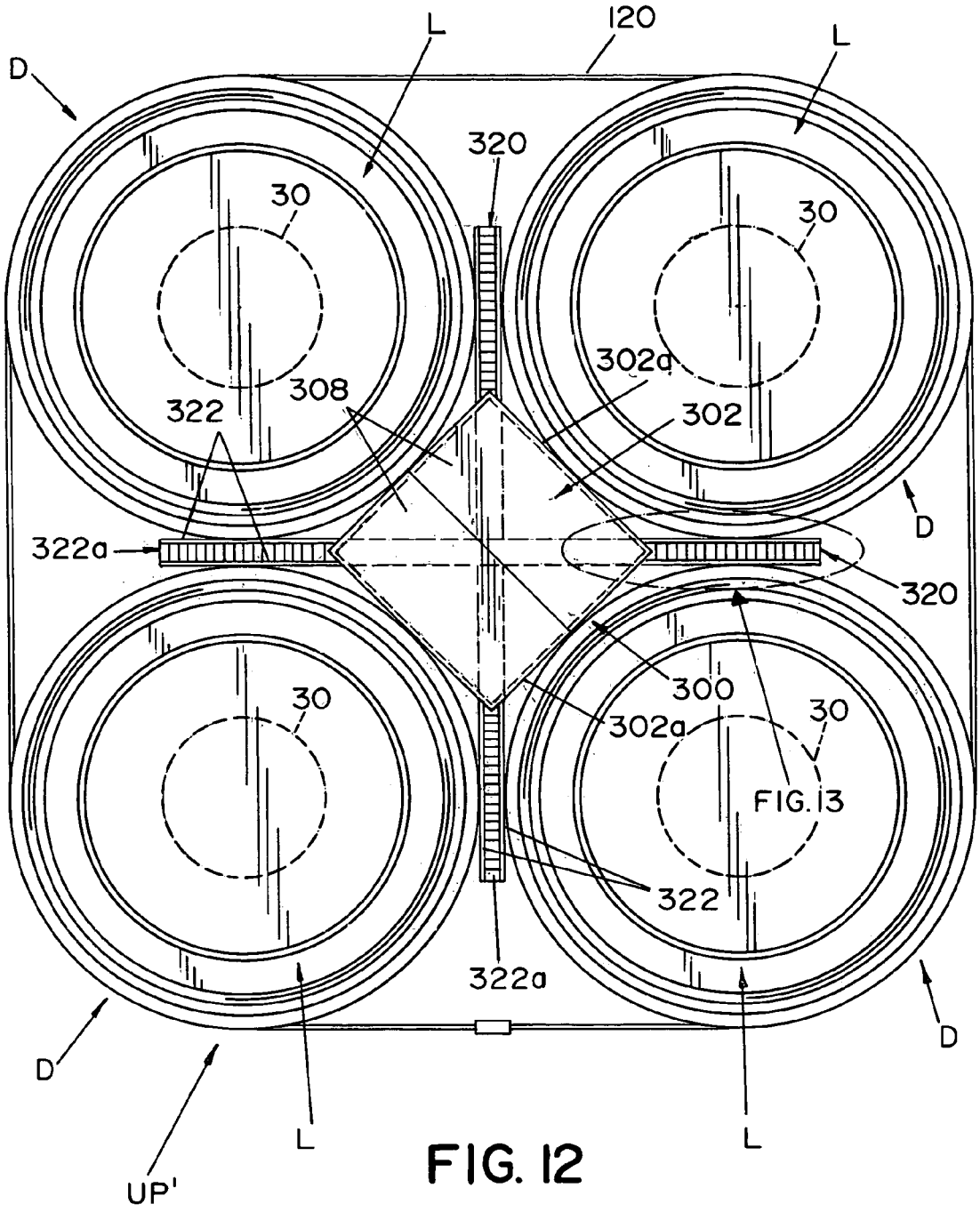
FIG. 12 is a top plan view of the preferred embodiment of the present invention illustrated in FIG. 11.
Figure 13:
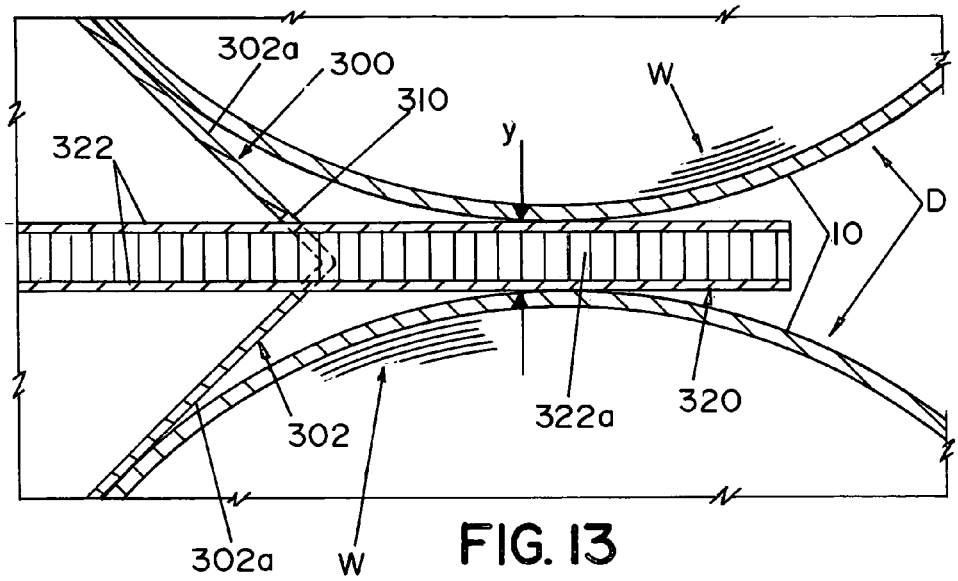
FIG. 13 is an enlarged partial view in the selected area identified in FIG. 12 and showing the operation of one arm of the spacer between two adjacent drums when using the spacer shown in FIGS. 11 and 12.
Figure 14:
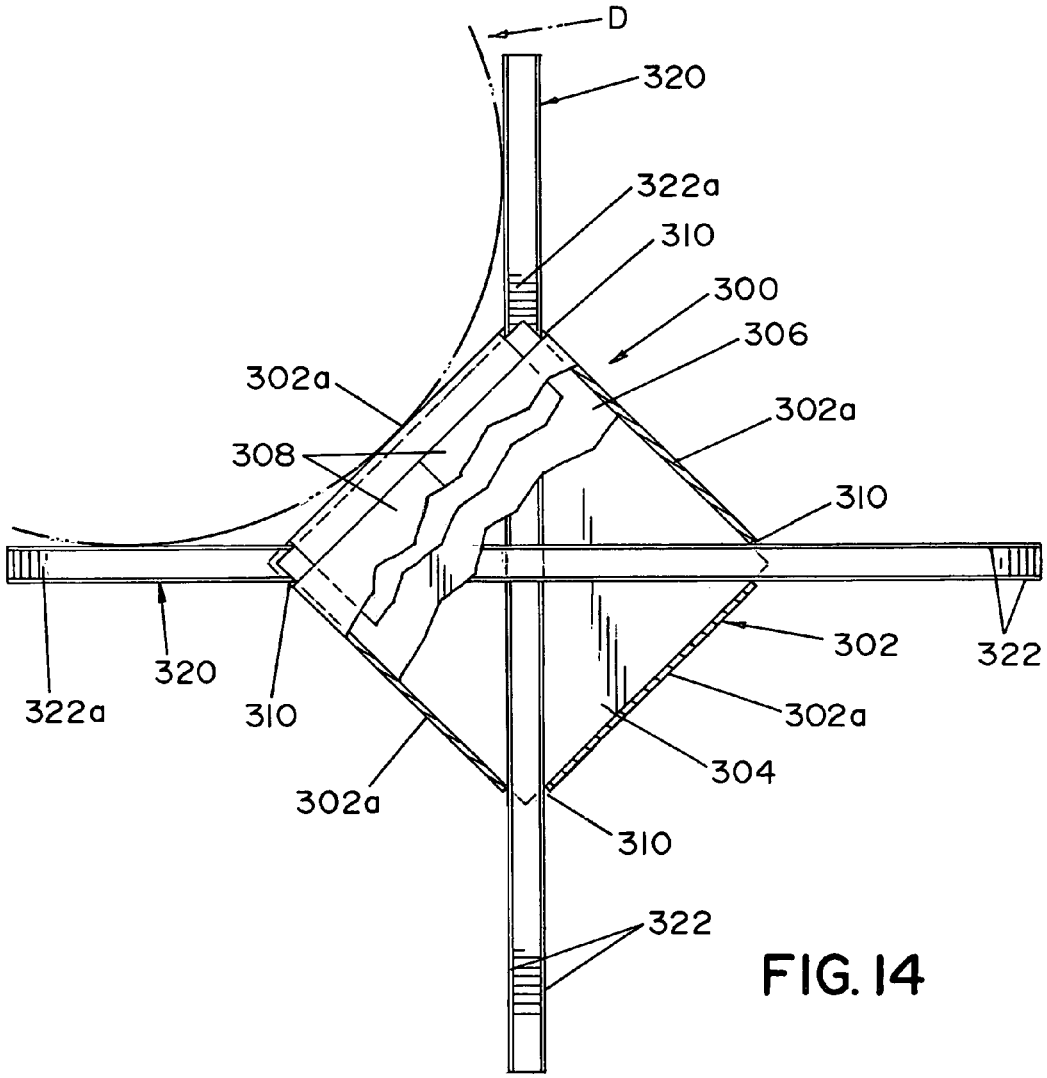
FIG. 14 is a top plan view in partial cross-section of the spacer used in the preferred embodiment of the present invention shown in FIGS. 11 and 12; and, FIG. 15 is a pictorial view somewhat in cross-section showing the spacer used in the preferred embodiment of the present invention as shown in FIGS. 11 and 12.
Figure 15:
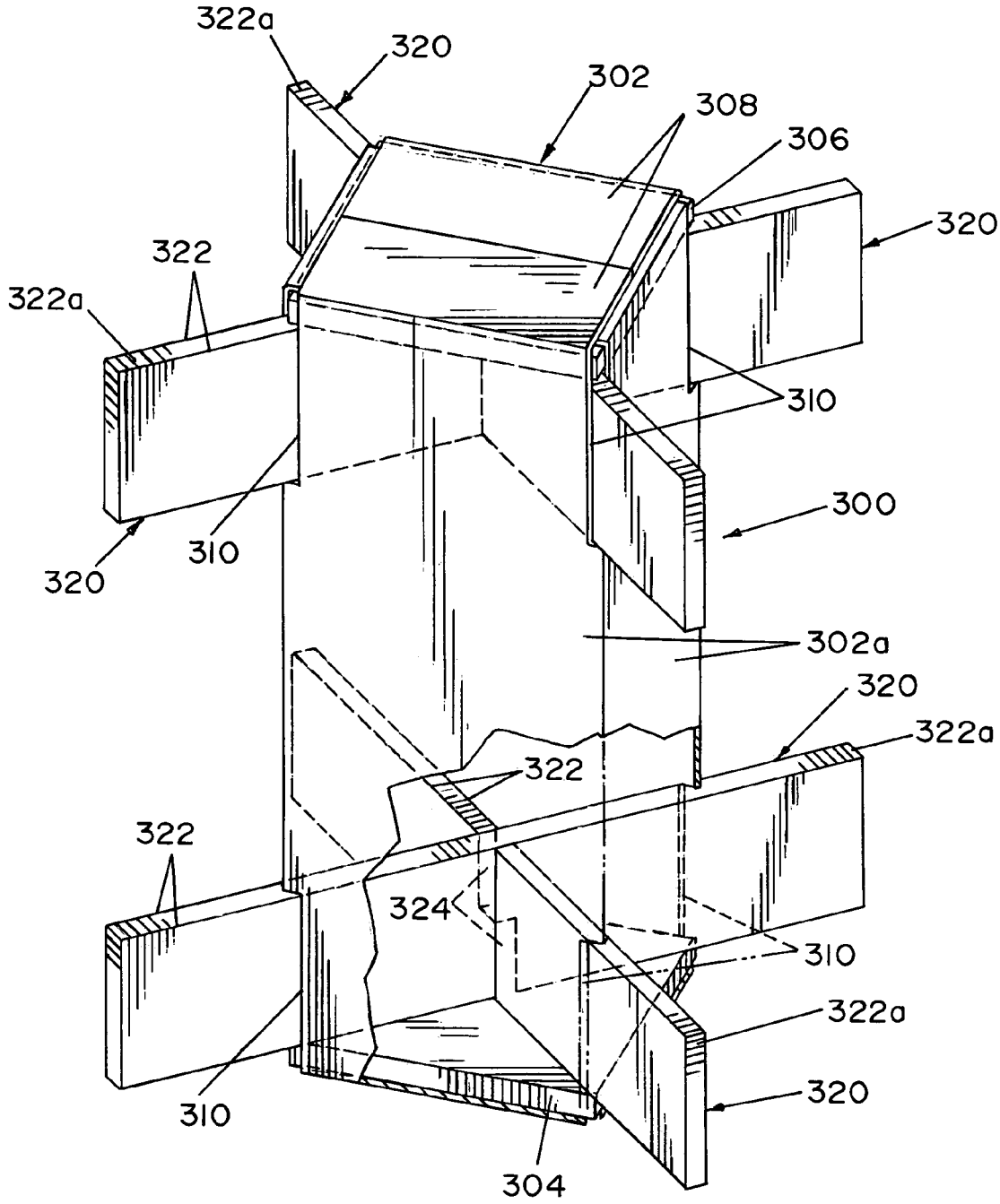

A preferred embodiment of the unitized package of the invention is illustrated in FIG. 11, similar to FIG. 8 but employing a different spacer 300. The spacer 300 performs the same function as spacer 100 and is best shown in FIGS. 12-15. Spacer 300 has a square vertically extending support box 302 with a lower arm support wall 304 and an upper arm support or capped wall 306. The upper wall 306 is captured by flaps 308 on box 302. This same flap closure structure is used at the bottom of box 302, below support wall 304. Box 302 includes four corner slits 310 at both the upper end and lower end of the box. Through these slits arms 320 protrude for separating adjacent drums D in unitized package UP'. Box 302 has surfaces **302*a* that orient the drums while arms 320 separate the drums a distance y. Arm 320 could be formed in various configurations; however, in the preferred embodiment, double skin 322, with honeycomb cores 322*a* have center notches 324. These notches interact to support plates 322 in orthogonal orientations for extension through corner diagonal opposite slits 310 of support box 302. Spacer 300 orients the four drums by surface 302*a* and maintains separation by arms 320**. Consequently, the chimes are not damaged and the lids L can be removed for successively using the drums of unitized package UP'. Other spacers could be used, as well as various number of drums could be assembled in the unitized package. In that situation, the surfaces orienting the drums would be correspondingly changed. Four drums is preferred and will be used in practice.

Having thus defined the invention, the following is claimed:

1. A unitized package including a plurality of drums filled with coiled welding wire, each of said drums comprising a cylindrical body, a top rim, a bottom rim and a bottom circular wall fixed to said bottom rim, said package including a spacer and a first and second band, said spacer positioned in a centralized space between the cylindrical bodies of said plurality of drums, said spacer including a first and second set of arms and a stanchion connected therebetween, each of said set of arms extending toward a space between two adjacent drums, one set of arms being adjacent said top rims of said adjacent drums and the other set of arms being adjacent the bottom rims of said adjacent drums, said first band stretched around said plurality of drums and positioned adjacent said top rim, said second band stretched around said plurality of drums and positioned adjacent said bottom rim.

2. The unitized package as defined in claim 1, wherein said unitized package is formed of four drums.

3. The unitized package as defined in claim 1, wherein said first set of arms is formed from a sheet of material.

4. The unitized package as defined in claim 2, wherein said first set of arms is formed from a sheet of material.

5. The unitized package as defined in claim 1, wherein said first set of arms includes two arms, said two arms including a contact element positioned between said two arms to engage and separate said drums.

6. The unitized package as defined in claim 4, wherein said first set of arms includes two arms, said two arms including a contact element positioned between said two arms to engage and separate said drums.

7. The unitized package as defined in claim 1, wherein each of said drums includes a riser network contacting to said bottom wall of each of said drums.

8. The unitized package as defined in claim 6, wherein each of said drums includes a riser network contacting said bottom wall of each of said drums.

9. The unitized package as defined in claim 7, wherein said riser network includes a lower support plate and two substantially parallel riser elements connected to said lower support plate.

10. The unitized package as defined in claim 8, wherein said riser network includes a lower support plate and two substantially parallel riser elements connected to said lower support plate.

11. The unitized package as defined in claim 9, wherein said substantially parallel riser elements are connected to said bottom wall of each of said drums.

12. The unitized package as defined in claim 10, wherein said substantially parallel riser elements are connected to said bottom wall of each of said drums.

13. The unitized package as defined in claim 1, including a shrink wrapping around said banded drums.

14. The unitized package as defined in claim 12, including a shrink wrapping around said banded drums.

15. A drum support arrangement for a drum adapted to be filled with coiled welding wire comprising a riser network and said drum, said drum comprising a cylindrical body with a center axis, a top rim, a bottom rim and a bottom circular wall fixed to said bottom rim, said riser network including a single lower support plate and a plurality of elongated elements affixed to said lower support plate, said plurality of elongated members fully supporting said bottom circular wall above said single lower support plate, said single lower support plate having a cross-sectional area that is less than said bottom circular wall and centrally positioned beneath said bottom circular wall, said elongated elements positioned between said single lower support plate and said bottom circular wall, said elongated elements having a height greater than about two inches and positioned substantially parallel to one another and spaced apart from one another, said elongated elements forming a space between said single lower support plate and said bottom circular wall, said space adapted to enable a fork lift truck prong to be inserted between said single lower support plate and said bottom circular wall and between said elongated members.

16. The drum support arrangement as defined in claim 15, wherein said lower support plate has a generally polygonal shape.

17. The drum support arrangement as defined in claim 15, wherein an upper surface of said elongated members directly contacts said bottom circular wall of said drum.

* * * * *